US005139589A

United States Patent [19]

Hartmanns

[11] Patent Number: 5,139,589

[45] Date of Patent: Aug. 18, 1992

[54] FUEL FOR USE INDEPENDENTLY OF ATMOSPHERIC AIR AND METHOD FOR PRODUCING THE FUEL

[75] Inventor: Joerg Hartmanns, Oldenburg, Fed. Rep. of Germany

[73] Assignee: ERNO Raumfahrttechnik GmbH, Bremen, Fed. Rep. of Germany

[21] Appl. No.: 731,543

[22] Filed: Jul. 17, 1991

[30] Foreign Application Priority Data

Jul. 26, 1990 [DE] Fed. Rep. of Germany ..... 4023738

[51] Int. Cl.[5] ..... C06B 45/32; D03D 23/00

[52] U.S. Cl. ..... 149/109.6; 149/6; 149/87

[58] Field of Search ..... 149/87, 109.6, 6

[56] References Cited

U.S. PATENT DOCUMENTS

| | | | |
|---|---|---|---|
| 2,960,394 | 11/1960 | Schrieber et al. | 149/87 |
| 3,153,902 | 10/1964 | Morrell | 149/87 |
| 3,607,470 | 9/1971 | Lucas | 149/6 |
| 3,779,723 | 12/1973 | Fuller et al. | 149/87 |
| 3,781,177 | 12/1973 | Kondis et al. | 149/6 |
| 3,812,237 | 5/1974 | Kirsch | 149/120 |
| 3,844,854 | 10/1974 | Self et al. | 149/6 |
| 4,758,288 | 7/1988 | Versic | 149/6 |
| 4,794,682 | 1/1989 | Buford | 149/6 |

*Primary Examiner*—Edward A. Miller
*Attorney, Agent, or Firm*—W. G. Fasse

[57] ABSTRACT

A fuel for use independently of atmospheric air by reaction with an oxidizer, has a metal hydride as a solid fuel component mixed into an inert liquid fuel component and 1.5 to 5.0 weight percent of a stearate as part of the solid fuel component. The liquid fuel component is preferably an easy flowing paraffin into which the stearate and the solid fuel component are mixed to form a liquified fuel that will react with a liquid oxidizer. The mixing is preferably performed at a temperature above 100° C. and at a reduced pressure less than $10^5$ Pa.

5 Claims, No Drawings

FUEL FOR USE INDEPENDENTLY OF ATMOSPHERIC AIR AND METHOD FOR PRODUCING THE FUEL

FIELD OF THE INVENTION

The invention relates to a fuel for use independently of atmospheric air and to a method for producing such a fuel. Such fuels are reacted with a separate oxidizer and are used, for example, where atmospheric oxygen is not available.

BACKGROUND INFORMATION

Engines used in space flight and engines for driving underwater devices, such as a torpedo, require a fuel that can be combusted independently of atmospheric oxygen. Such fuels usually comprise a further component functioning as an oxidizer and such further fuel component is usually present in liquid form. Fuels of this type include a solid fuel component in the form of a metal hydride and an inert liquid component, preferably an alkane in which the solid fuel component is embedded. When the solid fuel component is a hydride, it is preferably a hydride of the alkali metals or a metal powder embedded in a binder.

However, fuels for the above purpose are also known in the art in which the fuel component is provided in liquid form for example, as a hydrocarbon, such as hydrazine. Cryogenic hydrogen has also been used for this purpose in liquid form.

While the solid fuels have the advantage of a high energy density, the liquid fuels have the advantage of generally being more efficiently handled, particularly conveyed and controlled. In order to achieve the advantages of both types of fuel simultaneously, it has been suggested to use an alkali metal hydride, for example lithium hydride (LiH), which is embedded in granular form in a liquid paraffin ($C_{10}H_{20}$), whereby the resulting product has a paste-type viscous form. Problems have been encountered in practice with this type of viscous fuel because of the characteristic behaviour of alkali metal hydrides which tend to become instable, especially due to a premature release of hydrogen.

OBJECTS OF THE INVENTION

In view of the foregoing it is the aim of the invention to achieve the following objects singly or in combination:

- to improve a fuel of the type described above in such a manner that a destabilization, especially by a premature hydrogen release is reliably avoided;
- to provide a fuel for the above purposes, which can be advantageously stored and conveyed; and
- to provide a method for producing such a fuel.

SUMMARY OF THE INVENTION

According to the invention the metal hydride solid component of the fuel is intermixed with a stearate which is preferably lithium stearate ($C_{17}H_{35}COOLi$) which is present within the range of 1.5 to 5.0 percent by weight of the solid component, which is preferably a hydride of an alkali metal, preferably lithium hydride (LiH).

The liquid component of the fuel according to the invention comprises an alkane which is a liquid saturated hydrocarbon or a mixture of several alkanes to provide a preferred embodiment of the invention with a liquid component in the form of a easily flowable paraffin ($C_{10}H_{20}$) by means of which the entire fuel mixture is liquified so that granular components are avoided.

The addition of a stearate as taught by the invention to an alkali metal hydride prevents the premature release of a portion of the hydrogen that is bound in the alkali metal in the form of a hydride. The premature release of hydrogen has posed a substantial problem in the past because such premature release of hydrogen from the mixture of the solid fuel components and the inert liquid component caused a foaming and thus a destabilization of the fuel mixture.

DETAILED DESCRIPTION OF A PREFERRED EXAMPLE EMBODIMENT FOR PRODUCING THE PRESENT FUEL

According to the invention the metal hydride, especially the alkali metal hydride, is mixed with the stearate in a reduced pressure vessel at a pressure of less than $10^5$ Pa, preferably $10^2$ Pa at a temperature above 100° C. The stearate is preferably lithium stearate ($C_{17}H_{35}COOLi$), especially when the hydride is lithium hydride (LiH). In that case, the lithium stearate is added in the amount of 5 percent by weight of the solid fuel component. As a result of the mixing under reduced pressure at elevated temperatures, any free or atomic or molecular hydrogen that may be present on inner and outer surfaces of the hydride is removed so that a uniform distribution of the stearate on the surface of the hydride is assured, whereby the above mentioned premature hydrogen release is prevented with certainty.

The mixture of the solid fuel component of the metal hydride, especially alkali metal hydride with the stearate is then further mixed with an easy flowing low viscosity paraffin, for example, $C_{10}H_{20}$ to provide the liquid fuel. For combusting the so formed liquid fuel, the latter is brought together with an oxidizer, such as lithium chlorate ($LiClO_3$) which is solved in water to provide a fuel for a thermodynamic power plant, such as for torpedos. This type of fuel is equally suitable for use as a rocket propellant.

Although the invention has been described with reference to specific example embodiments, it will be appreciated that it is intended to cover all modifications and equivalents within the scope of the appended claims.

What I claim is:

1. A method for mixing a fuel for use independently of atmospheric air, comprising the following steps:

(a) mixing a metal hydride as a solid fuel component in a sealed mixing vessel with a stearate added to said metal hydride within the range of 1.5 to 5.0 percent by weight to form a stearate metal hydride mixture, (b) maintaining the temperature of said metal hydride and of said stearate above 100° C. during said mixing, (c) maintaining a reduced pressure in said sealed mixing vessel of less than $10^5$ Pa, steps (a) through (c) being effective to provide a uniform distribution of stearate or the hydride, and (d) mixing an inert fuel component with said stearate metal hydride mixture sufficient to form a liquid fuel.

2. The method of claim 1 wherein said mixing is performed at a pressure of about $10^2$ Pa.

3. The method of claim 1, wherein said inert fuel component is selected from the group consisting of an easy flowing low viscosity paraffin, and an alkane to form said liquid fuel.

4. The method of claim 1, wherein said metal hydride is lithium hydride, and wherein said stearate is lithium stearate added to the extent of 5 percent by weight.

5. The method of claim 1, wherein said metal hydride is an alkali metal hydride.

* * * * *

UNITED STATES PATENT AND TRADEMARK OFFICE

CERTIFICATE OF CORRECTION

PATENT NO. : 5,139,589

DATED : August 18, 1992

INVENTOR(S) : Joerg Hartmanns

It is certified that error appears in the above-identified patent and that said Letters Patent is hereby corrected as shown below:

Claim 1, column 2, line 61, replace "or" by --on--.

Claim 2, column 2, line 65, replace "1" by --1,--.

Signed and Sealed this

Twenty-fourth Day of August, 1993

Bruce Lehman

*Attest:*

BRUCE LEHMAN

*Attesting Officer*

*Commissioner of Patents and Trademarks*